US007182571B2

(12) United States Patent
Selby

(10) Patent No.: US 7,182,571 B2
(45) Date of Patent: Feb. 27, 2007

(54) VARIABLE STATOR VANE ACTUATING LEVERS

(75) Inventor: Alan L Selby, Denby (GB)

(73) Assignee: Rolls-Royce plc, London (GB)

( * ) Notice: Subject to any disclaimer, the term of this patent is extended or adjusted under 35 U.S.C. 154(b) by 53 days.

(21) Appl. No.: 10/845,081

(22) Filed: May 14, 2004

(65) Prior Publication Data

US 2005/0135926 A1 Jun. 23, 2005

(30) Foreign Application Priority Data

May 30, 2003 (GB) ..... 0312381.7

(51) Int. Cl.
*F01D 17/16* (2006.01)

(52) U.S. Cl. ..... 415/156; 415/160; 415/162; 74/519; 403/154; 403/155

(58) Field of Classification Search ..... 415/119, 415/156, 159–166; 74/519; 403/150, 154, 403/155; 267/158, 160, 173, 174
See application file for complete search history.

(56) References Cited

U.S. PATENT DOCUMENTS

| | | | | |
|---|---|---|---|---|
| 2,639,139 | A * | 5/1953 | Carlson | 267/158 |
| 3,054,608 | A * | 9/1962 | Pava | 267/160 |
| 4,668,165 | A * | 5/1987 | Ludwick | 415/156 |
| 4,693,027 | A * | 9/1987 | Wolff et al. | 267/158 |
| 4,763,885 | A * | 8/1988 | Zamitter | 267/158 |
| 4,767,264 | A * | 8/1988 | Kisling et al. | 415/156 |
| 4,979,874 | A * | 12/1990 | Myers | 415/160 |
| 5,048,996 | A * | 9/1991 | DuBois et al. | 403/155 |
| 5,492,446 | A | 2/1996 | Hawkins | |
| 5,518,332 | A * | 5/1996 | Katoh | 403/155 |
| 6,019,574 | A * | 2/2000 | DiBella | 415/160 |
| 6,824,355 | B2 * | 11/2004 | Behrendt et al. | 415/160 |
| 2003/0147743 | A1 | 8/2003 | Chatel | |

FOREIGN PATENT DOCUMENTS

| | | | |
|---|---|---|---|
| GB | 0 868 355 SP | 5/1961 | |
| GB | 1 519 583 SP | 8/1978 | |
| GB | 2 232 725 A | 12/1990 | |
| WO | WO-01/69044 A1 * | 9/2001 | 415/160 |

* cited by examiner

*Primary Examiner*—Christopher Verdier
(74) *Attorney, Agent, or Firm*—W. Warren Taltavull; Manelli, Denison & Selter PLLC

(57) ABSTRACT

A variable stator vane actuating lever (50) for use in a compressor (20) of a gas turbine engine (10). The lever (50) comprises a first end (52) for pivotal connection to a stator vane actuator ring (36) and a second end (54) for abutting a stator vane spindle (32). The stator vane spindle (32) has a diameter and flat positions (56,58,60,62). The second end (54) of the lever (50) has resilient members (64,66) for abutting the flat portions (56,58,60,62) of the stator vane spindle (32) at diametrically opposite locations. The resilient members (64,66) are integral with the second end (54) of the stator vane spindle (32) and are curved so that they are substantially tubular to provide even load distribution and improved location of the lever (50) on the stator vane spindle (32).

18 Claims, 4 Drawing Sheets

VARIABLE STATOR VANE ACTUATING LEVERS

FIELD OF THE INVENTION

Embodiments of the present invention relate to a variable stator vane actuating lever for use in a gas turbine engine and/or a system for positioning variable stator vanes.

BACKGROUND OF INVENTION

FIG. 1 shows a typical compressor 20 of a gas turbine engine. The compressor 20 comprises a casing 22 and a plurality of sets of rotor blades 24 mounted for rotation about a longitudinal axis of the compressor 20. Upstream of each set of rotor blades 24 is mounted a set of variable stator vanes 26, each having a first end 28 and a second end 30 rotatably mounted in the casing 22. The first end 28 includes a stator vane spindle 32 mounted for rotation in a bush 34 in the casing 22.

A stator vane actuator ring 36 extends circumferentially around the outside of the casing 22 adjacent to each set of stator vanes 26. Each stator vane spindle 32 is mechanically connected to an adjacent actuator ring 36 by a variable stator vane actuating lever 38. Each actuating lever 38 has a first end 40 pivotally connected to an adjacent actuator ring 36 and a second end 42 immovably attached to an upper end 44 of each vane spindle 32 by a bolt 46 or stud and nut.

Each actuator ring 36 is circumferentially rotatable in either direction about the longitudinal axis of the compressor 20, as indicated by arrow A. This is conventionally achieved by use of an actuating system (not shown). The actuating system may be hydraulic, pneumatic or electric, etc. When an actuator ring 36 is caused to rotate, its rotational movement is transmitted by each of the plurality of actuating levers 38 to the respective stator vane spindles 32 of a set of variable stator vanes 26 causing the spindles 32 to rotate in their respective bushes 34. Rotation of the spindles 32 in turn causes simultaneous rotation of the corresponding set of variable stator vanes 26.

Variable stator vanes are used in gas turbine engines to control airflow through a multi-stage compressor. In the event of breakdown of airflow through the compressor, a condition known as 'surge' can occur in which high pressure air is expelled from the combustor into the compressor stages, thereby causing a sudden reversal of the airflow through the compressor and a resultant sudden loss of engine thrust.

Under surge conditions, the reversed airflow can impart a significant shock load onto the variable stator vanes, inducing rotational vibration. Existing variable stator vane actuating levers transmit most of this load to the actuating system, which may cause damage. It would be desirable to reduce the likelihood of such damage occurring in such situations and/or similar situations.

SUMMARY OF THE INVENTION

According to a first aspect of the present invention, there is provided a variable stator vane actuating lever for use in a gas turbine engine, the lever comprising a first end for pivotal connection to a stator vane actuator and a second end for abutting a stator vane spindle having a diameter and flat portions, the second end having resilient members for abutting the flat portions of the vane spindle at diametrically opposite locations.

The actuating lever may have first and second resilient members, the first resilient member extending in a first direction and returning in a second direction to abut the vane spindle at a first flat portion and the second resilient member extending in the second direction and returning in the first direction to abut the vane spindle at a second flat portion. The first and second resilient members may each extend from the second end of the actuating lever and curve through first and second curved portions and terminate at an unconstrained end.

The first and second resilient members may have opposing surfaces, which may define therebetween a gap for receiving the vane spindle. The opposing surfaces may abut, in use, the flat portions of the vane spindle. The opposing surfaces may be curved and may each abut, in use, the vane spindle at two locations.

A pin may be provided at the first end of the actuating lever to provide for pivotal connection of the actuating lever to the stator vane actuator.

According to a second aspect of the present invention there is provided a stator vane assembly comprising an actuating lever according to any of the preceding four paragraphs and a stator vane spindle, wherein the stator vane spindle has a longitudinal axis and the resilient members are symmetric about the longitudinal axis.

According to a third aspect of the present invention, there is provided a stator vane assembly comprising an actuating lever according to any of the preceding five paragraphs, a stator vane spindle having a longitudinal axis, and a constraint locatable on the vane spindle to abut the resilient members and constrain movement thereof.

The constraint may include first and second curved portions for abutting respectively the first and second resilient members and may also be symmetric about the longitudinal axis of the vane spindle.

A fastener may be provided to secure the second end of the actuating lever to the vane spindle.

According to a fourth aspect of the present invention, there is provided a variable stator vane actuating lever for use in a gas turbine engine, the lever comprising; a first end for pivotal connection to a stator vane actuator, and a second end including:

a first resilient member extending in a first direction and returning in a second direction to form a first curved portion for abutting a stator vane spindle, and;

a second resilient member extending in the second direction and returning in the first direction to form a second curved portion for abutting the stator vane spindle.

The first and second resilient members may have opposing surfaces for abutting the stator vane spindle.

According to a fifth aspect of the present invention, there is provided a system for positioning variable stator vanes comprising a variable stator vane actuator, a stator vane spindle associated with each stator vane having a diameter and flat portions, and a plurality of variable stator vane actuating levers each having a first end for pivotal connection to the actuator and a second end having resilient members for abutting the flat portions of a vane spindle and providing for relative rotational movement between the vane spindle and the actuating lever.

The stator vane spindle may have a longitudinal axis and the flat portions may be symmetric about the longitudinal axis. The flat portions may include first and second flattened surfaces substantially parallel to the longitudinal axis of the vane spindle. The flat portions may also include third and fourth flattened surfaces inclined with respect to the longitudinal axis of the vane spindle.

The present invention also provides a gas turbine engine including a system for positioning variable stator vanes as defined in any of the two preceding paragraphs.

BRIEF DESCRIPTION OF THE DRAWINGS

An embodiment of the present invention will now be described by way of example only with reference to the accompany drawings, in which.

DETAILED DESCRIPTION OF THE INVENTION

Figure 1:
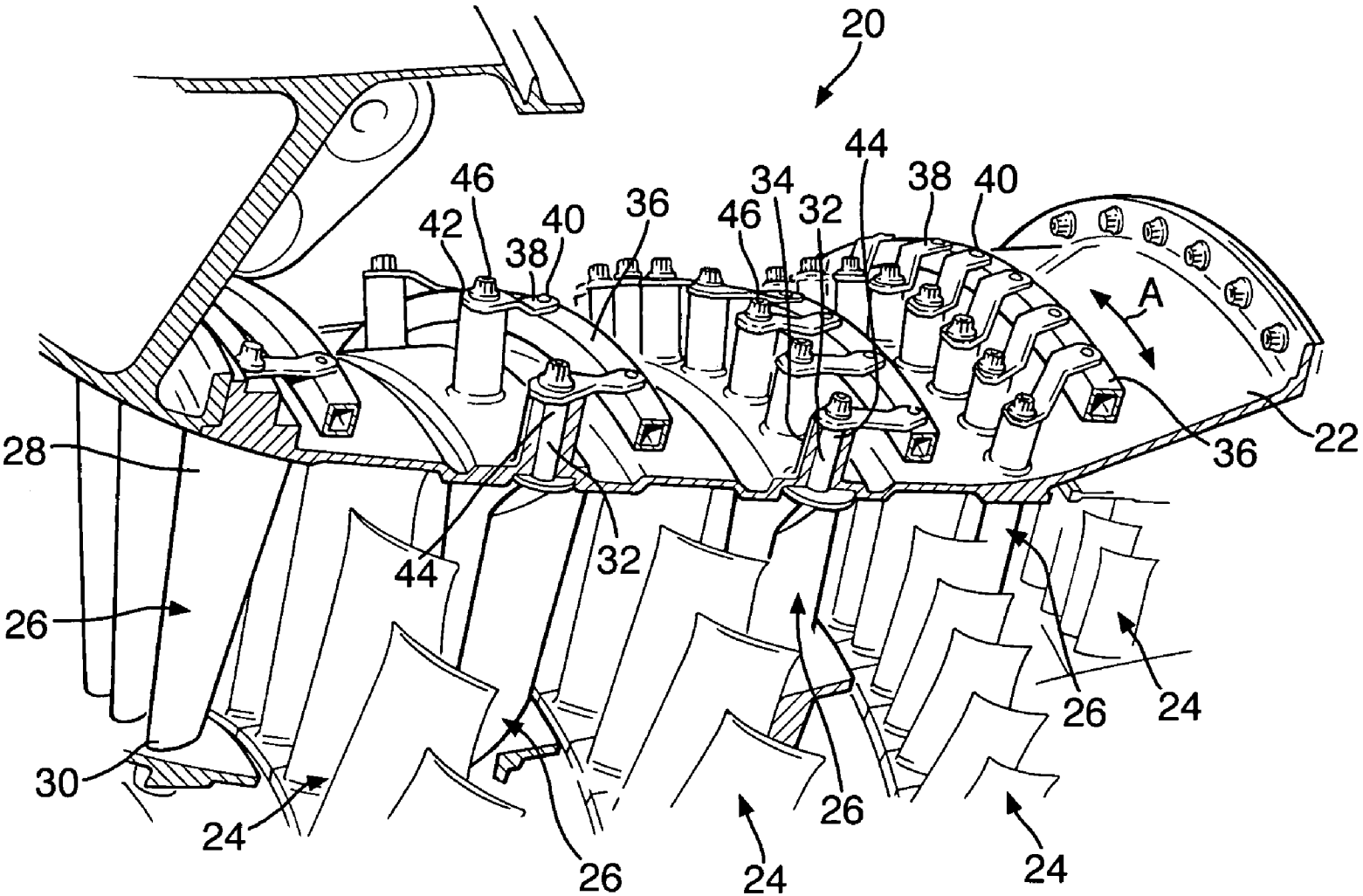
FIG. 1 is a diagrammatic perspective view of a compressor for a gas turbine engine.
Figure 2:
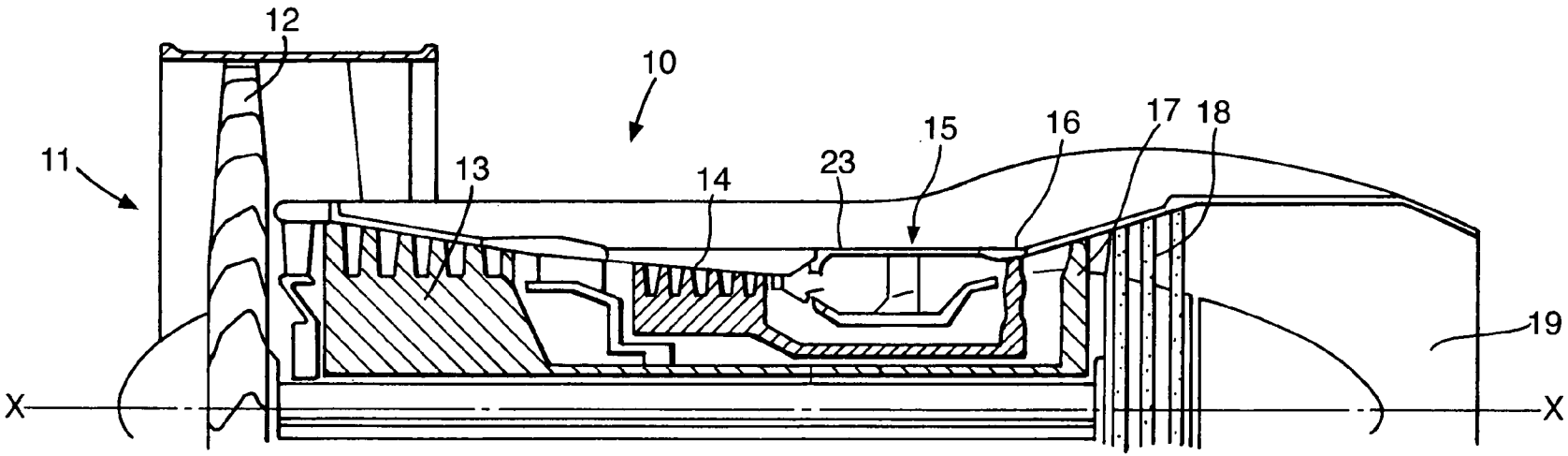
FIG. 2 is a diagrammatic cross-sectional view of a part of a gas turbine engine.

Referring to FIG. 2, a gas turbine engine is generally indicated at 10 and comprises, in axial flow series, an air intake 11, a propulsive fan 12, an intermediate pressure compressor 13, a high pressure compressor 14, combustion equipment 15, a high pressure turbine 16, an intermediate pressure turbine 17, a low pressure turbine 18 and an exhaust nozzle 19.

The gas turbine engine 10 works in a conventional manner so that air entering the intake 11 is accelerated by the fan 12 which produces two air flows: a first air flow into the intermediate pressure compressor 13 and a second air flow which provides propulsive thrust. The intermediate pressure compressor 13 compresses the air flow directed into it before delivering that air to the high pressure compressor 14 where further compression takes place.

The compressed air exhausted from the high pressure compressor 14 is directed into the combustion equipment 15 where it is mixed with fuel and the mixture combusted. The resultant hot combustion products then expand through, and thereby drive, the high, intermediate and low pressure turbines 16, 17 and 18 before being exhausted through the nozzle 19 to provide additional propulsive thrust. The high, intermediate and low pressure turbines 16, 17 and 18 respectively drive the high and intermediate pressure compressors 14 and 13, and the fan 12 by suitable interconnecting shafts.

Figure 3:
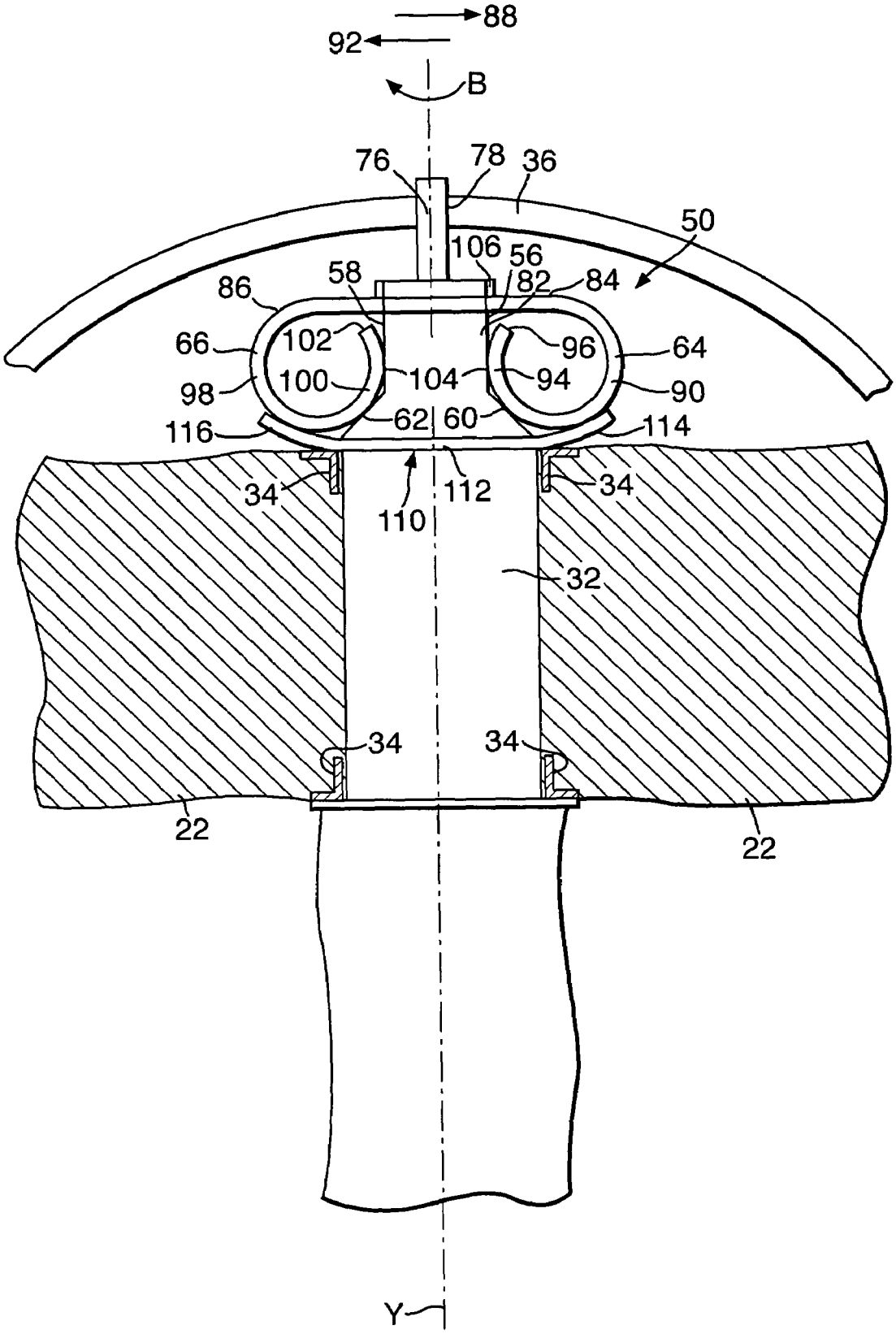
FIG. 3 is a diagrammatic cross-sectional view of a stator vane actuating assembly including a variable stator vane actuating lever according to the present invention.
Figure 4:
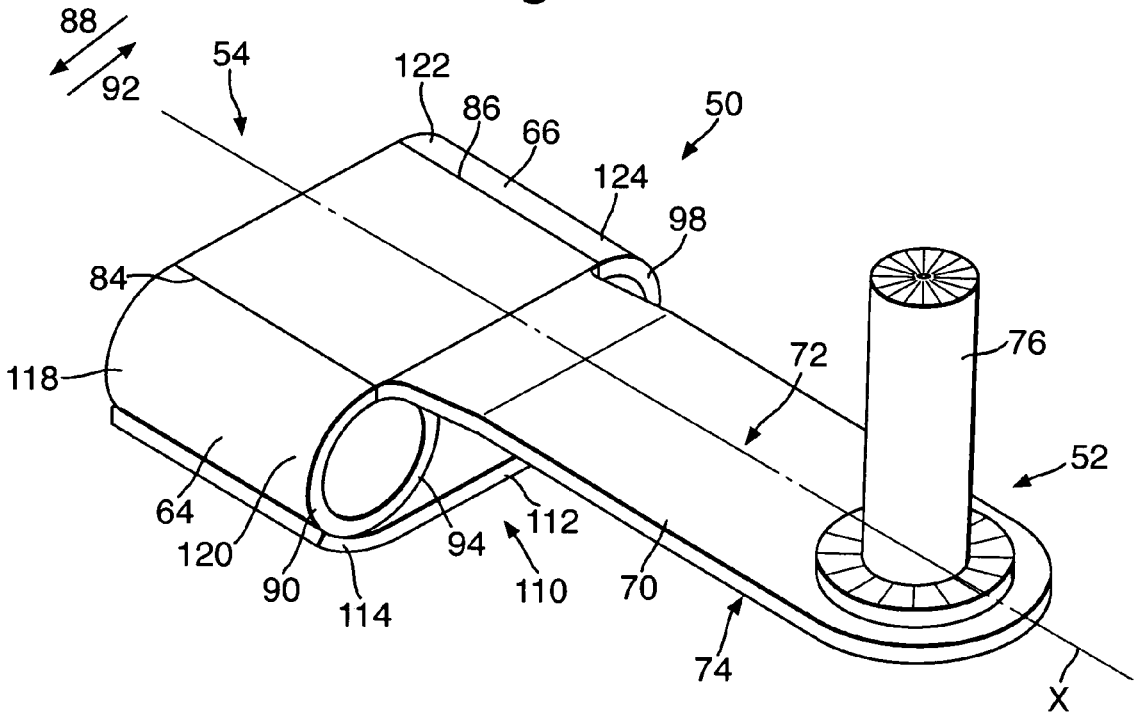
FIG. 4 is a diagrammatic perspective view of the variable stator vane actuating lever of FIG. 3.

FIGS. 3 and 4 show a variable stator vane actuating assembly for a gas turbine engine comprising a stator vane spindle 32, a constraint 110, and a variable stator vane actuating lever 50. The actuating lever 50 comprises generally a first end 52 for pivotal connection to a stator vane actuator such as an actuator ring 36 and a second end 54 for abutting a stator vane spindle 32. The stator vane spindle 32 has a diameter and flat portions such as first, second, third and fourth flattened surfaces 56, 58, 60, 62. The second end 54 has first and second resilient members 64, 66 for abutting the flat portions 56, 58, 60, 62 of the vane spindle 32 at diametrically opposite locations.

In more detail, the actuating lever 50 is formed from a titanium metal strip having upper and lower surfaces 72, 74 and a longitudinal axis X extending between the first and second ends 52, 54. At the first end 52 of the lever 50 on the upper surface 72 is provided a pin 76 locatable in a bush 78 of the actuator ring 36 to provide for the pivotal connection of the first end 52 of the lever 50 to the actuator ring 36.

As best seen in FIG. 3, the vane spindle 32 is rotatably mounted about its longitudinal axis Y in bushes 34 in the compressor casing 22 and has an upper portion 82 which extends beyond the casing 22. At the upper portion 82, the vane spindle 32 has first and second flattened surfaces 56, 58 which are substantially parallel to each other and the longitudinal axis Y of the spindle 32 and located on opposite sides of the spindle 32. The upper portion 82 also has third and fourth flattened surfaces 60, 62 which are inclined with respect to the longitudinal axis Y of the spindle and again located on opposite sides thereof. The first and third surfaces 56, 60 are located adjacent each other, and meet, on one side of the vane spindle 32. The second and fourth flattened surfaces 58, 62 are located adjacent each other, and meet, on the opposite side of the spindle 32. The first and third flattened surfaces 56, 60 and the second and fourth flattened surfaces 58, 62 are symmetrically positioned, with reflectional symmetry about the longitudinal axis Y, and together form a 'cottage roof'.

At the second end 54 of the actuating lever 50, the first and second resilient members 64, 66 extend from, and are integrally formed with, the metal strip 70 providing the first and second resilient members 64, 66 with a respective constrained end 84, 86. The first resilient member 64 extends from the actuating lever 50 in a first direction 88 perpendicular to a vertical plane through the longitudinal axis X of the actuating lever 50, downwardly curves through a first curved portion 90 and upwardly curves through a second curved portion 94 and terminates at an unconstrained free end 96. In a similar manner, the second resilient member 66 extends from the actuating lever 50 initially in a second direction 92 which is opposite to the first direction 88 and again perpendicular to a vertical plane through the longitudinal axis X of the actuating lever 50, downwardly curves through a first curved portion 98 and upwardly curves through a second curved portion 100 and terminates at an unconstrained free end 102.

The first and second resilient members 64, 66 are symmetric about the vertical plane through the longitudinal axis X of the actuating lever 50 and extend a short distance from the second end 54 towards the first end 52 parallel to the longitudinal axis X, such that the first and second resilient members 64, 66 are substantially tubular. This distance corresponds substantially to the width of the corresponding flattened surfaces 56, 58, 60, 62 of the vane spindle 32. The first resilient member 64 has front and rear portions 118, 120 and the second resilient member 66 front and rear portions 122, 124.

The second curved portions 94, 100 of the first and second resilient members 64, 66 have opposing surfaces 104 which define a gap for receiving the upper portion 82 of the vane spindle 32. The curved opposing surfaces 104 of the first and second resilient members 64, 66 each abut the first and second flattened surfaces 56, 58, and also the third and fourth flattened surfaces 60, 62, at diametrically opposite locations. Thus, each of the resilient members 64, 66 abuts the upper portion 82 of the vane spindle 32 at two diametrically opposite locations. The diameter of the vane spindle 32 extends at right angles to the longitudinal axis Y of the vane spindle 32.

The second end 54 of the actuating lever 50 is secured to the upper end 44 of the vane spindle 32 by means of a threaded fastener 106, such as a nut, or stud and nut.

A constraint 110 is optionally located on the vane spindle 32 on the upper portion 82 adjacent the compressor casing 22. The constraint 110 includes a substantially planar portion 112 and first and second curved portions 114, 116 which abut respectively the first and second resilient members 64, 66 to constrain movement thereof. The constraint 110 is symmetric about the longitudinal axis Y of the vane spindle 32.

Under normal engine operating conditions, the first and second resilient members 64, 66 are sufficiently stiff to transmit steady movement of the actuator ring 36 via the actuating lever 50 to the vane spindle 32, without significant relative movement occurring between the actuating lever 50 and the vane spindle 32.

Under surge conditions, the actuating lever 50 acts as a shock absorber. When a shock load is exerted on the stator vane 26 under surge conditions, it will vibrate by rotating rapidly in one direction, then in the other direction. This will cause the vane spindle 32 to vibrate in the same manner. When the vane spindle 32 rotationally vibrates in this way, the resilient members 64, 66 of the actuating lever 50 deform to allow relative movement between the vane spindle 32 and the actuating lever 50. For example, when the vane spindle 32 rotates in the direction of arrow B shown in FIG. 3, the rear portion 120 and the front portion 122 of the first and second resilient members 64, 66 are compressed outwardly due to contact with the flattened surfaces 56, 58, 60, 62 of the spindle 32, whilst the front portion 118 and the rear portion 124 of the first and second resilient members 64, 66 expand inwardly. When the direction of rotation of the vane spindle 32 reverses, the front portion 118 and the rear portion 124 of the first and second resilient members 64, 66 are compressed outwardly whereas the rear portion 120 and the front portion 122 of the first and second resilient members 64, 66 expand inwardly. This alternate deformation of the resilient members 64, 66 by compression and expansion continues until the rotational vibration of the vane spindle 32 ceases. The curved portions 114, 116 of the constraint 110, when present, constrain movement of, and provide additional stiffness to, the first and second resilient members 64, 66. Due to the symmetry of the constraint 110, it tends to apply substantially equal restraining forces to both the first and second resilient members 64, 66.

After the rotational vibration of the stator vane 26, and hence the vane spindle 32, has ceased, the inherent stiffness of the first and second resilient members 64, 66 causes them to return to their undeformed state to abut the flattened surfaces 56, 58, 60, 62 of the vane spindle 32. This ensures proper location of the actuating lever 50 on the vane spindle 32 once the vibration has subsided.

The large contact area between the first and second resilient members 64, 66 and the respective flattened surfaces 56, 58, 60, 62 of the vane spindle 32 ensures there is an even load distribution and also provides for improved location of the actuating lever 50 on the vane spindle 32.

By deforming in the manner described, the first and second resilient members 64, 66 enable some of the shock load experienced under surge conditions to be absorbed by allowing relative movement between the vane spindle 32 and the actuating lever 50. This reduces the load transmitted to the actuator ring 36 by the actuating lever 50, thereby reducing the likelihood of damage to these components and increasing the probability of the surge being recoverable.

Various modifications may be made without departing from the scope of the present invention as defined in the accompanying claims. For example, whilst the actuating lever has been described for use in a compressor of a gas turbine engine, it could alternatively or additionally be used in the turbine. The resilient members 64, 66 may be of a different configuration. The constraint 110 may be replaced by a shim or omitted. The actuating lever 50 may be manufactured from materials other than titanium, such as stainless steel, another metal or a composite material.

Whilst endeavouring in the foregoing specification to draw attention to those features of the invention believed to be of particular importance, it should be understood that the Applicant claims protection in respect of any patentable feature or combination of features hereinbefore referred to and/or shown in the drawings, whether or not particular emphasis has been placed thereon.

I claim:

1. A variable stator vane assembly for use in a gas turbine engine comprising an actuating lever and a stator vane spindle having a longitudinal axis, a diameter around the longitudinal axis and flat portions at diametrically opposite locations, the lever comprising a first end for pivotal connection to a stator vane actuator and a second end having resilient members abutting the flat portions of the stator vane spindle, wherein a fastener is provided to secure the second end of the actuating lever to the vane spindle.

2. A variable stator vane assembly according to claim 1, wherein the actuating lever has first and second resilient members, wherein the first resilient member extends in a first direction and returns in a second direction to abut the vane spindle at a first flat portion and the second resilient member extends in the second direction and returns in the first direction to abut the vane spindle at a second flat portion.

3. A variable stator vane assembly according to claim 2, wherein the first and second resilient members each extend from the second end of the actuating lever and curve through first and second curved portions and terminate at a respective first and second unconstrained end.

4. A variable stator vane assembly according to claim 2, wherein the first and second resilient members have opposing surfaces.

5. A variable stator vane assembly according to claim 4, wherein the opposing surfaces define therebetween a gap for receiving the vane spindle.

6. A variable stator vane assembly according to claim 4, wherein the opposing surfaces abut, in use, the flat portions of the vane spindle.

7. A variable stator vane assembly according to claim 4, wherein the opposing surfaces are curved and each abuts, in use, the vane spindle at two locations.

8. A variable stator vane assembly according to claim 1, wherein a pin is provided at the first end of the actuating lever to provide for pivotal connection of the actuating lever to the stator vane actuator.

9. A variable stator vane assembly according to claim 1, wherein and the resilient members are symmetric about the longitudinal axis.

10. A variable stator vane assembly according to claim 1, further comprising a constraint locatable on the stator vane spindle to abut the resilient members and constrain movement of the resilient members.

11. A variable stator vane assembly according to claim 10, wherein the constraint includes first and second curved portions for abutting respectively the first and second resilient members.

12. A variable stator vane assembly according to claim 10, wherein the constraint is symmetric about the longitudinal axis of the vane spindle.

13. A system for positioning variable stator vanes comprising a variable stator vane actuator, a stator vane spindle associated with each stator vane having a diameter and flat portions at diametrically opposite locations on the outermost periphery of the vane spindle, and a plurality of variable stator vane actuating levers each having a first end for pivotal connection to the actuator and a second end having resilient members which abut the flat portions of a vane spindle and provide for relative rolational movement between the vane spindle and the actuating lever.

14. A system according to claim 13, wherein the stator vane spindle has a longitudinal axis and the flat portions are symmetric about the longitudinal axis.

15. A system according to claim 14, wherein the flat portions include first and second flattened surfaces substantially parallel to the longitudinal axis of the vane spindle.

16. A system according to claim 14, wherein the flat portions include third and fourth flattened surfaces inclined with respect to the longitudinal axis of the vane spindle.

17. A system according to claim 13, wherein each of the plurality of variable stator vane actuating levers comprises a first end for pivotal connection to a stator vane actuator and a second end having resilient members abutting the flat portions of the stator vane spindle.

18. A gas turbine engine including a system for positioning variable stator vanes as defined in claim 13.

* * * * *